US010370952B2

(12) United States Patent
Jamison et al.

(10) Patent No.: US 10,370,952 B2
(45) Date of Patent: Aug. 6, 2019

(54) DRILLING OPERATIONS THAT USE COMPOSITIONAL PROPERTIES OF FLUIDS DERIVED FROM MEASURED PHYSICAL PROPERTIES

(71) Applicant: Halliburton Energy Services, Inc., Houston, TX (US)

(72) Inventors: Dale E. Jamison, Humble, TX (US); Cato Russell McDaniel, Montgomery, TX (US); Shawn L. Broussard, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 689 days.

(21) Appl. No.: 14/419,267

(22) PCT Filed: Jan. 9, 2014

(86) PCT No.: PCT/US2014/010779
§ 371 (c)(1),
(2) Date: Feb. 3, 2015

(87) PCT Pub. No.: WO2015/105489
PCT Pub. Date: Jul. 16, 2015

(65) Prior Publication Data

US 2016/0024906 A1 Jan. 28, 2016

(51) Int. Cl.
*E21B 44/00* (2006.01)
*E21B 47/10* (2012.01)
(Continued)

(52) U.S. Cl.
CPC ..... *E21B 44/00* (2013.01); *E21B 21/08* (2013.01); *E21B 43/34* (2013.01); *E21B 44/02* (2013.01); *E21B 47/10* (2013.01)

(58) Field of Classification Search
CPC ..... E21B 44/00; E21B 21/06; E21B 21/08
See application file for complete search history.

(56) References Cited

U.S. PATENT DOCUMENTS 2,900,337 A * 8/1959 Earley ..... C09K 8/32 507/129
3,911,740 A * 10/1975 Calhoun ..... E21B 21/08 175/48
(Continued)

FOREIGN PATENT DOCUMENTS

WO 2007005822 A2 1/2007
WO 2009085496 A1 7/2009
(Continued)

OTHER PUBLICATIONS

Canadian Office Action from Canadian Patent Application No. 2,932,733, dated May 11, 2017.
(Continued)

*Primary Examiner* — D. Andrews
(74) *Attorney, Agent, or Firm* — Tenley Krueger; C. Tumey Law Group PLLC

(57) ABSTRACT

The physical properties of a fluid may be used in deriving the compositional properties of the fluid, which may, in turn, be used to influence an operational parameters of a drilling operation. For example, a method may include drilling a wellbore penetrating a subterranean formation with a drilling fluid as part of a drilling operation; circulating or otherwise containing the drilling fluid in a flow path that comprises the wellbore; measuring at least one physical property of the drilling fluid at a first location and a second location along the flow path; deriving a compositional property of the drilling fluid at the first location and the second location based on the at least one physical property that was measured; comparing the compositional property of the drilling fluid at the first location and the second location;
(Continued)

and changing an operational parameter of the drilling operation based on the comparison.

12 Claims, 2 Drawing Sheets

(51) Int. Cl.

| | |
|---|---|
| ***E21B 43/34*** | (2006.01) |
| ***E21B 21/08*** | (2006.01) |
| ***E21B 44/02*** | (2006.01) |

(56) References Cited

U.S. PATENT DOCUMENTS

| | | | | |
|---|---|---|---|---|
| 4,802,143 | A * | 1/1989 | Smith | E21B 21/08 175/40 |
| 6,176,323 | B1 | 1/2001 | Weirich et al. | |
| 6,443,242 | B1 | 9/2002 | Newman et al. | |
| 7,317,989 | B2 | 1/2008 | DiFoggio et al. | |
| 7,830,161 | B2 | 11/2010 | Murphy | |
| 8,575,541 | B1 | 11/2013 | Jamison et al. | |
| 2003/0168257 | A1 | 9/2003 | Aldred et al. | |
| 2009/0194330 | A1 * | 8/2009 | Gray | E21B 21/00 175/24 |
| 2011/0284288 | A1 * | 11/2011 | Sawyer | E21B 49/005 175/24 |
| 2013/0192360 | A1 | 8/2013 | Jamison et al. | |
| 2013/0312481 | A1 | 11/2013 | Pelletier et al. | |

FOREIGN PATENT DOCUMENTS

| | | |
|---|---|---|
| WO | WO-2012078764 A2 | 6/2012 |
| WO | 2015105489 | 7/2015 |

OTHER PUBLICATIONS

Halliburton brochure entitled Real Time Density and Viscosity (RTDV) Measurement Unit, Automated Measurement of Drilling Fluid Properties, 2012.

Technical Brief 2011 vol. 2, Particle Sciences, Drug Development Services, "Emulsion Stability and Testing," 2011.

International Search Report and Written Opinion for PCT/US2014/010779 dated Oct. 21, 2014.

* cited by examiner

DRILLING OPERATIONS THAT USE COMPOSITIONAL PROPERTIES OF FLUIDS DERIVED FROM MEASURED PHYSICAL PROPERTIES

BACKGROUND

The embodiments described herein relate to measuring the physical properties of a fluid and deriving the compositional properties of the fluid. In some instances, the methods and system described herein relate to using the compositional properties of the fluid derived from the physical properties of the fluid to influence the operational parameters of a drilling operation.

Drilling fluids are often used to aid the drilling of wellbores into subterranean formations, for example, to remove cuttings from the borehole, control formation pressure, and cool, lubricate and support the bit and drilling assembly. Typically, the drilling fluid, which is more commonly referred to as "mud," is pumped down the borehole through the interior of the drill string, out through nozzles in the end of the bit, and then upwardly in the annulus between the drill string and the wall of the borehole. During the ascent, some of the mud congeals, forming a cake on the exposed face of the wellbore, for example, to prevent the mud from being lost to the porous drilled formation. In addition, the pressure inside the formation can be partially or fully counterbalanced by the hydrostatic weight of the mud column in the wellbore. Since the mud has a variety of vital drilling functions, it must accordingly have comparable and reliable capabilities.

Many drilling parameters, such as measured depth, string rotary speed, weight on bit, downhole torque, surface torque, flow in, surface pressure, down hole pressure, bit orientation, bit deflection, etc., can be made available in real time. However, the composition of the drilling fluid, which can be critical to effective hydraulic modeling and hole cleaning performance, is not readily available in real time. Ascertaining the composition of the drilling fluid typically requires a direct measurement by a technician (or "mud engineer"). The on-site mud engineer, for example, typically has numerous other responsibilities in his/her daily routine and therefore cannot provide a constant stream of drilling fluid composition to a monitoring center. In addition, taking and/or generating such measurements are time consuming and inherently susceptible to human error.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Figure 1:
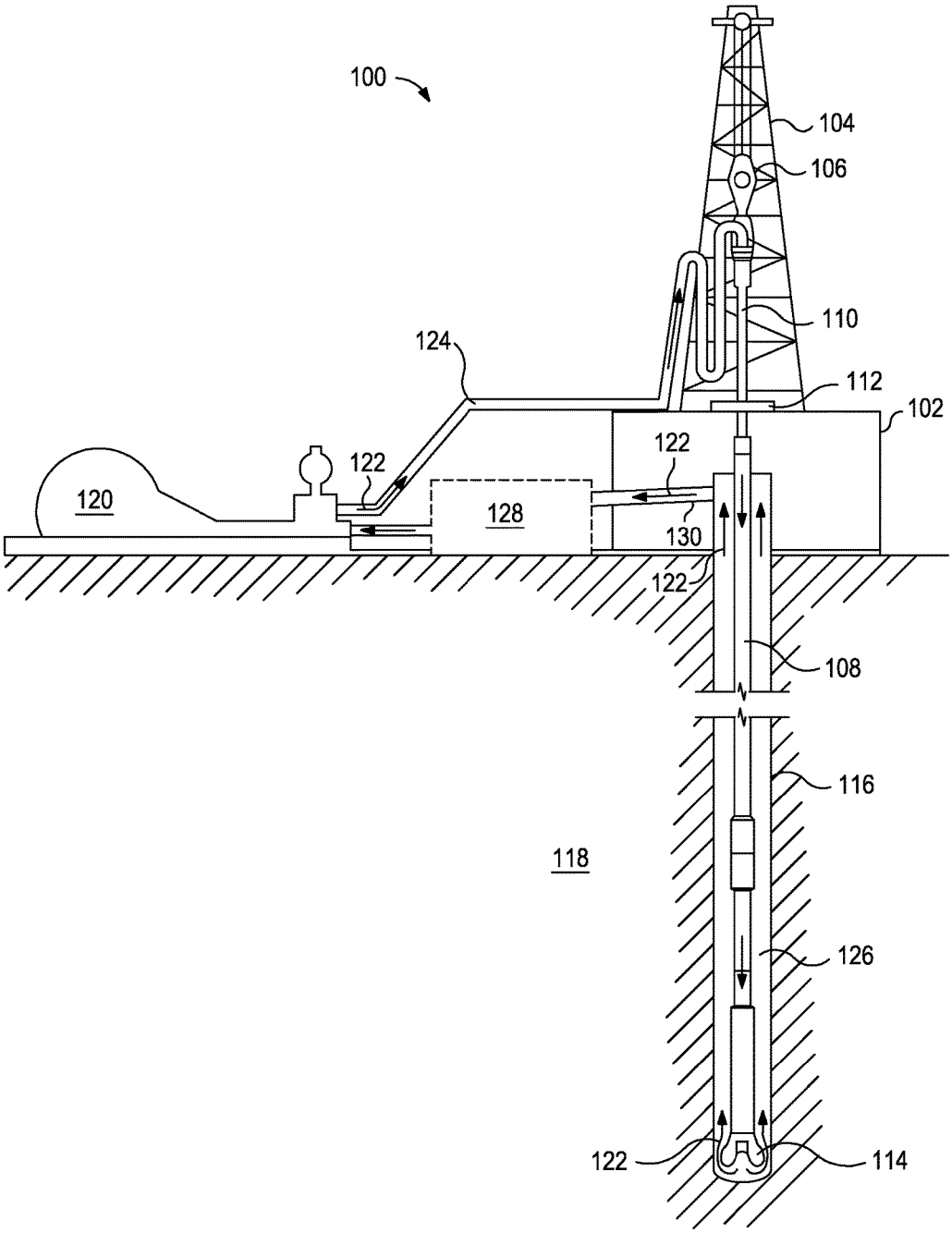
FIG. 1 provides an illustration of a drilling assembly suitable for use in at least some embodiments described herein.

The embodiments described herein relate to measuring the physical properties of a fluid and deriving the compositional properties of the fluid. In some instances, the methods and system described herein relate to using the compositional properties of the fluid derived from the physical properties of the fluid to influence the operational parameters of a drilling operation.

In some embodiments, the methods and systems described herein utilize inexpensive, easy measurement techniques of physical properties of a fluid to derive compositional data about the fluid. Relative to drilling operations, because the methods and systems described herein provide for automation and straightforward measurement techniques, the manpower can be greatly reduced while the amount of information about the drilling operation can be greatly increased. This information can be used to modify the operational parameters to increases the efficacy and efficiency of the drilling operation.

Some embodiments may involve measuring at least one physical property of a fluid and deriving at least one compositional property of the fluid based on the at least one physical property.

Examples of physical properties that may be used to derive compositional properties may include, but are not limited to, viscosity, density, thermal conductivity, dielectric constant, resistivity, electrical stability, emulsion stability, heat capacity, electrical impedance, permittivity, refractive index, absorptivity, and the like, and any combination thereof.

Examples of compositional properties that may be derived from physical properties may include, but are not limited to, the presence or absence of a component in the fluid, the concentration of a component in the fluid, and the like, and any combination thereof. The components of the fluid include chemicals and particles designed to be in the fluid and contaminants in the fluid.

Relative to drilling operations and drilling fluids, examples of components that may be in a fluid (designed or contaminants) may include, but are not limited to, the continuous phase of the fluid, the discontinuous phase of the fluid (e.g., emulsions), cuttings, gas, low gravity solids (e.g., materials having a specific gravity less than about 2.6 like calcium carbonate, marble, polyethylene, polypropylene, graphitic materials, silica, limestone, dolomite, salt crystals, shale, bentonite, kaolinite, sepiolite, illite, hectorite, insoluble polymeric materials, and organoclays), high gravity solids (e.g., materials having a specific gravity of about 2.6 or greater like barite, hematite, ilmenite, galena, manganese oxide, iron oxide, magnesium tetroxide, magnetite, siderite, celestite, dolomite, manganese carbonate, insoluble polymeric materials), lost circulation materials (e.g., sand, shale, ground marble, bauxite, ceramic materials, glass materials, metal pellets, silica, alumina, fumed carbon, carbon black, graphite, mica, titanium dioxide, meta-silicate, calcium silicate, kaolin, talc, zirconia, boron, fly ash, hollow glass microspheres, solid glass, high strength synthetic fibers, resilient graphitic carbon, cellulose flakes, wood, resins, polymer materials (crosslinked or otherwise), polytetrafluoroethylene materials, nut shell pieces, cured resinous particulates comprising nut shell pieces, seed shell pieces, cured resinous particulates comprising seed shell pieces, fruit pit pieces, cured resinous particulates comprising fruit pit pieces, composite materials, basalt fibers, woolastonite fibers, non-amorphous metallic fibers, metal oxide fibers, mixed metal oxide fibers, ceramic fibers, glass fibers, mixed metal oxide fibers, metal oxide fibers, polymeric fibers, cellulosic fibers, and any combination thereof), and the like, and any combination thereof.

One skilled in the art would recognize the relation of physical properties and compositional properties. By way of nonlimiting example, Formulas I and II provide a relationship between thermal conductivity (k) and volume fraction (φ) of the components (m) of a fluid.

$$\beta_i = k_i/k_0 \quad \text{Formula I}$$

$$\frac{k_m}{k_0} = \left[1 + \sum_{i=1}^{m} (\beta_i^{1/3} - 1)\varphi_i\right]^3 \quad \text{Formula II}$$

where: $k_i$ is thermal conductivity of the $i^{th}$ component $k_0$ is the thermal conductivity of the base fluid $\varphi_i$ is the volume fraction of the $i^{th}$ component $k_m$ is the thermal conductivity of the drilling fluid comprising m components In another nonlimiting example, Formula III provides a relationship between shear stress (σ) and volume fraction (φ) of the components (m) of a fluid. Formula III may be used in calculating the concentration of multiple (e.g., a low gravity solid, a first lost circulation material and a second lost circulation material) using one or more shear stress measurements.

$$\frac{\sigma_{i,m}}{\sigma_{i,0}} = \prod_{j=1}^{m}\left[1 + \frac{\left(\left(1 + 2.5\varphi_j + A\varphi_j^2 + Be^{C\varphi_j}\right) - \left(1 + 2.5\varphi_{j-1} + A\varphi_{j-1}^2 + Be^{C\varphi_{j-1}}\right)\right)}{\left(1 + 2.5\varphi_{j-1} + A\varphi_{j-1}^2 + Be^{C\varphi_{j-1}}\right)}\right] \quad \text{Formula III}$$

where: $\sigma_{i,m}$ is the shear stress of the drilling fluid comprising m components at an $i^{th}$ rheometer dial reading $\sigma_{i,0}$ is the is the shear stress of the base fluid at an $i^{th}$ rheometer dial reading A, B, and C are empirical constants unique to each of the m components $\varphi_j$ is the volume fraction of the $j^{th}$ component The values for A, B, and C may be determined experimentally by varying the volume fraction of the $j^{th}$ component at varying $i^{th}$ rheometer dial readings.

In yet another nonlimiting example, Formulas IV and V provide a relationship between density (ρ) and volume fraction (φ) of the components (m) of a fluid.

$$\rho_m = \rho_0 - \Sigma_{i=1}^{m}\rho_i\varphi_i \text{ for } \rho_m < \rho_0 \quad \text{Formula IV}$$

$$\rho_m = \rho_0 + \Sigma_{i=1}^{m}\rho_i\varphi_i \text{ for } \rho_m > \rho_0 \quad \text{Formula V}$$

where: $\rho_f$ is density of the drilling fluid comprising m components $\rho_0$ is density of the base fluid $\rho_i$ is density of the $i^{th}$ component $\rho_i$ is the volume fraction of the $i^{th}$ component One skilled in the art would recognize that the above formulas may be combined so that more than one physical property can be used to derive at least one compositional property of the fluid.

The physical properties may be measured with any suitable measuring equipment (e.g., sensors, gauges, and the like). Examples of measuring equipment suitable for use in drilling operations may include, but are not limited to, rheometers, viscometers, thermocouples, dielectric constant meters, conductivity meters, resistivity meters, electrical stability meters (e.g., disclosed in U.S. patent application Ser. No. 12/192,763), pycnometers, spectrometers (e.g., infrared spectrometer and UV-vis spectrometer), optical microscopes, acoustic sensors, x-ray fluorometers, polarimeters, and the like, and any combination thereof.

In some instances, a physical property may be derived from another physical property. For example, the rheological properties of a fluid may be used to derive the density of the fluid.

The measuring equipment may be in any suitable location within a system for performing a drilling operation. For example, FIG. 1 illustrates a drilling assembly 100. It should be noted that while FIG. 1 generally depicts a land-based drilling assembly, those skilled in the art will readily recognize that the principles described herein are equally applicable to subsea drilling operations that employ floating or sea-based platforms and rigs, without departing from the scope of the disclosure.

The drilling assembly 100 may include a drilling platform 102 that supports a derrick 104 having a traveling block 106 for raising and lowering a drill string 108. The drill string 108 may include, but is not limited to, drill pipe and coiled tubing, as generally known to those skilled in the art. A kelly 110 supports the drill string 108 as it is lowered through a rotary table 112. A drill bit 114 is attached to the distal end of the drill string 108 and is driven either by a downhole motor and/or via rotation of the drill string 108 from the well surface. As the bit 114 rotates, it creates a borehole (or wellbore) 116 that penetrates various subterranean formations 118.

A pump 120 (e.g., a mud pump) circulates a drilling fluid along flow path 122 through a feed pipe 124 and to the kelly 110, which conveys the drilling fluid downhole through the interior of the drill string 108 and through one or more orifices in the drill bit 114. The drilling fluid is then circulated along the flow path 122 back to the surface via an annulus 126 defined between the drill string 108 and the walls of the borehole 116. At the surface, the recirculated or spent drilling fluid exits the annulus 126 and may be conveyed to one or more fluid processing area(s) 128 along the flow path 122 via an interconnecting flow line 130. While illustrated as being arranged at the outlet of the borehole 116 via the annulus 126, those skilled in the art will readily appreciate that the fluid processing area(s) 128 may be arranged at any other location in the drilling assembly 100 to facilitate its proper function, without departing from the scope of the scope of the disclosure.

The measuring equipment suitable for measuring physical properties of the drilling fluid along the flow path 122 may be coupled to at least one of the pump 120, the drill string 108, the rotary table 112, the drill bit 114, equipment within the one or more fluid processing area(s) 128, and the like. The data from the measuring equipment may be transmitted (wired or wirelessly) to a computing station that implements the derivation(s) described herein of the at least one compositional property from the at least one physical property.

Figure 2:
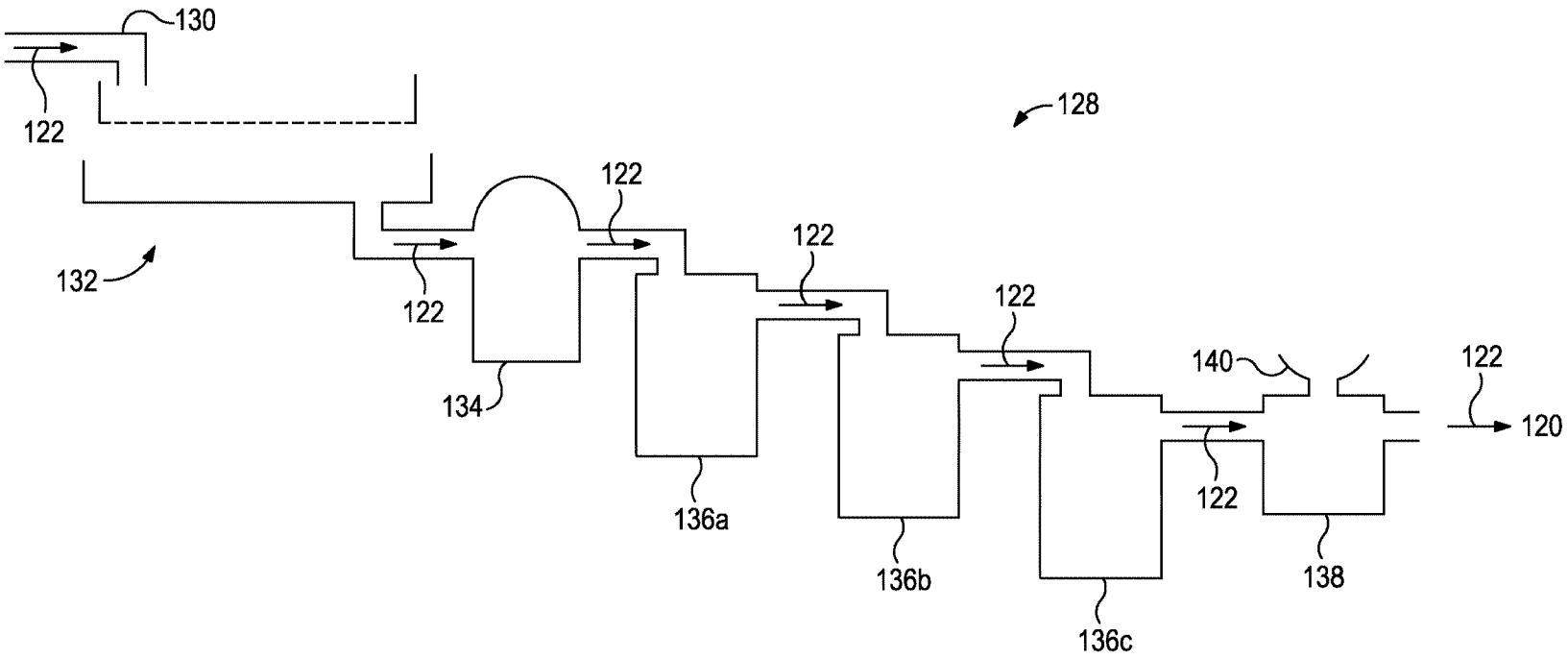
FIG. 2 provides an illustration of a fluid processing area of a drilling assembly suitable for use in at least some embodiments described herein.

FIG. 2 provides an illustration of an example of a fluid processing area 128 suitable for use in the drilling assembly 100 of FIG. 1. The interconnecting flow line 130 introduces the drilling fluid into shaker 132 along flow path 122. The portion of the drilling fluid that passes through the sieves of the shaker 132 is then sent to centrifuge 134 along flow path 122. The drilling fluid from the centrifuge 134 may then pass through a series of retention pits 136*a*,136*b*,136*c* before flowing to a mixer 138 along flow path 122. A hopper 140 of the mixer 138 may be useful in adding components to the drilling fluid. After the mixer 138, the drilling fluid is conveyed along flow path 122 to the pump 120 of FIG. 1. As used herein, the term "centrifuge" encompasses any separation equipment that utilizes centrifugal force (e.g., a hydrocyclone). One skilled in the art will recognize that the fluid processing area 128 of FIG. 2 is merely an example and may be in any other suitable configuration and include or exclude equipment based on the needs of a particular drilling operation.

In some embodiments during a drilling operation, a drilling fluid may be circulated through or otherwise contained within a flow path that includes a wellbore penetrating a subterranean formation. A physical property(s) of the drilling fluid may be measured at a location along the flow path over a period of time. Then, the compositional property(s) of the drilling fluid derived from the physical property(s) may be monitored or compared over the time period. This comparison may reveal a change in the composition of the drilling fluid, which may compel a change to an operational parameter of the drilling operation. Measurements over a time period may, in some instances, be continuous, at set intervals, on demand, or a combination thereof.

Examples of suitable locations for monitoring the compositional property(s) of the drilling fluid may include, but are not limited to, locations that are before, at, or after at least one of the wellbore, the drill string, the drill bit, the shaker, the centrifuge, the retention pit, the mixer, the pump, and the like, and any combination thereof.

By way of nonlimiting example, retention pits are periodically emptied to remove solids in the drilling fluid that have settled. Typically, field tests of the composition of the drilling fluid provide an indication of when the concentration of solids. When this concentration reaches a threshold set by the operator, the retention pits are emptied. In some embodiments, a physical property(s) and the compositional property(s) derived therefrom of the drilling fluid in a retention pit may be monitored over time. When the concentration of solids in the drilling fluid reaches a threshold, the retention pit may be emptied. This allows for this portion of the drilling operation to be monitored and potentially executed without significant manpower.

In some embodiments during a drilling operation, a drilling fluid may be circulated through or otherwise contained within a flow path that includes a wellbore penetrating a subterranean formation. A physical property(s) of the drilling fluid may be measured at two or more locations along the flow path. Then, the compositional property(s) of the drilling fluid derived from the physical property(s) at each location along the flow path may be compared. This comparison may reveal a change in the composition of the drilling fluid, which may compel a change to an operational parameter of the drilling operation.

Examples of locations where the comparison of compositional property(s) may be suitable may include, but are not limited to, along the flow path before and after the wellbore, before and after a shaker, before and after a centrifuge, before and after a retention pit, before and after a mixer, before a shaker and after a centrifuge, before a shaker and after a retention pit, before a centrifuge and after a retention pit, before and after a series of retention pits, before a series of retention pits and between retention pits in the series, and the like, any hybrid thereof, and any combination thereof. As used herein, relative to the location of a measurement of a physical property(s) of the drilling fluid, the terms "before" and "after" refer to any location along the flow path before or after, respectively, the location but not before or after, respectively, another piece of equipment that significantly changes the composition of the fluid. However, there may be equipment disposed between the before and after locations. For example, a location before a centrifuge does not encompass before a shaker that is disposed earlier in the flow path. In another example, before a shaker and after a retention pit encompasses where the flow path includes, in order, a shaker, a centrifuge, and a retention pit.

Examples of operational parameters may include, but are not limited to, a flow rate of the drilling fluid, a revolutions per minute of a drill bit, a rate of penetration of a drill bit into the subterranean formation, a torque applied to a drill string, a trajectory of a drill bit, a weight on a drill bit, a wellbore pressure, an equivalent circulating density, a concentration of a component of the drilling fluid, a weight of the drilling fluid, a viscosity of the drilling fluid, and the like, and any combination thereof.

By way of nonlimiting example, when comparing compositional properties from before entering the wellbore (e.g., at the beginning of the drill string 108 of FIG. 1) and after exiting the wellbore (e.g., at the interconnecting flow line 130 of FIG. 1), the comparison may reveal that the amount of lost circulation material has decreased significantly. This may indicate that a high-permeability portion of the subterranean formation has been encountered and the lost circulation materials are incorporating therein to reduce the permeability therethrough. As such, the concentration of lost circulation materials may be increased to enhance plugging and mitigate drilling fluid loss into the formation (e.g., by addition at the mixer 138 of FIG. 2).

By way of another nonlimiting example, when comparing compositional properties before and after the centrifuge 134 of FIG. 2, the comparison may reveal that the centrifuge is not sufficiently reducing the concentration of a component in the drilling fluid. As such, the operational parameters of the centrifuge (e.g., rpm, residence time, and the like) may be modified.

By way of yet another nonlimiting example, when comparing compositional properties at the entrance and exit of a retention pit or between a series of retention pits 136*a*,136*b*, 136*c* of FIG. 2, the comparison may reveal that the retention time in at least one retention pit is not sufficient to allow for the solids to sufficiently settle, which may be changed accordingly.

By way of another nonlimiting example, when comparing compositional properties at the entrance and exit of a shaker 132 of FIG. 2, the comparison may reveal that the concentration of cuttings passing through the shaker is unacceptably high. As such, a smaller mesh size screen may be included in the system to remove more cuttings from the drilling fluid.

In some instances, a predicted compositional property may be calculated based on theoretical change to at least one operation parameter. This predicted compositional property may be compared to a compositional property derived from a measured physical property(s) of the drilling fluid at a given location in the flow path (e.g., anywhere measuring equipment may be placed). Comparing the predicted compositional property and the compositional property derived from the measured physical property(s) may reveal a previously unknown aspect of the wellbore, which may compel a change to an operational parameter of the drilling operation. One skilled in the art would recognize how to predict a compositional property based on a theoretical change. For example, the concentration of cuttings is related to the rate of penetration of a drill bit into the subterranean formation.

By way of nonlimiting example, an actual cuttings concentration higher than a predicted cuttings concentration may indicate that the gauge of the wellbore is larger than expected. To mitigate the continued formation of a larger wellbore, the equivalent circulating density may be lowered. If the actual cuttings concentration is significantly higher, it may indicate a washout area that needs to be stabilized, which may be achieved with the inclusion of an additive in the drilling fluid (e.g., a clay stabilizer or a plugging agent) or with the deployment of a mechanical stabilization tool (e.g., an expandable tubular).

In some embodiments, the physical property(s) and compositional property(s) derived therefrom (and, when used, the predicted compositional property(s) described herein) may be monitored (or predicted) and compared over a period of time (e.g., continuously, at defined time intervals, or on-demand). In such cases, a fluctuation in the comparison (e.g., sudden or gradual) may compel a change to an operational parameter of the drilling operation.

By way of nonlimiting example, a sudden increase in cuttings concentration as determined by the methods described herein may indicate that a washout or void space has been encountered in the subterranean formation during a drilling operation. As such, that portion of the wellbore may need to be stabilized, which may be achieved with the inclusion of an additive in the drilling fluid (e.g., a clay stabilizer or a plugging agent) or with the deployment of a mechanical stabilization tool (e.g., an expandable tubular).

In some embodiments, the measuring of the physical property(s), deriving the computational property(s), optionally calculating the predicted computational property(s), and the changing of an operational parameter(s) may be operated under computer control, remotely and/or at the well site. In some embodiments, the computer and associated algorithm for each of the foregoing can produce an output that is readable by an operator who can manually change the operational parameters. In some embodiments, an operator may provide an acceptable value range for the various comparisons described herein, such that when the comparison is outside this range the operator or computer may change an operational parameter(s) accordingly.

It is recognized that the various embodiments herein directed to computer control and artificial neural networks, including various blocks, modules, elements, components, methods, and algorithms, can be implemented using computer hardware, software, combinations thereof, and the like. To illustrate this interchangeability of hardware and software, various illustrative blocks, modules, elements, components, methods and algorithms have been described generally in terms of their functionality. Whether such functionality is implemented as hardware or software will depend upon the particular application and any imposed design constraints. For at least this reason, it is to be recognized that one of ordinary skill in the art can implement the described functionality in a variety of ways for a particular application. Further, various components and blocks can be arranged in a different order or partitioned differently, for example, without departing from the scope of the embodiments expressly described.

Computer hardware used to implement the various illustrative blocks, modules, elements, components, methods, and algorithms described herein can include a processor configured to execute one or more sequences of instructions, programming stances, or code stored on a non-transitory, computer-readable medium. The processor can be, for example, a general purpose microprocessor, a microcontroller, a digital signal processor, an application specific integrated circuit, a field programmable gate array, a programmable logic device, a controller, a state machine, a gated logic, discrete hardware components, an artificial neural network, or any like suitable entity that can perform calculations or other manipulations of data. In some embodiments, computer hardware can further include elements such as, for example, a memory (e.g., random access memory (RAM), flash memory, read only memory (ROM), programmable read only memory (PROM), erasable read only memory (EPROM)), registers, hard disks, removable disks, CD-ROMS, DVDs, or any other like suitable storage device or medium.

Executable sequences described herein can be implemented with one or more sequences of code contained in a memory. In some embodiments, such code can be read into the memory from another machine-readable medium. Execution of the sequences of instructions contained in the memory can cause a processor to perform the process steps described herein. One or more processors in a multi-processing arrangement can also be employed to execute instruction sequences in the memory. In addition, hard-wired circuitry can be used in place of or in combination with software instructions to implement various embodiments described herein. Thus, the present embodiments are not limited to any specific combination of hardware and/or software.

As used herein, a "machine-readable medium" refers to any medium that directly or indirectly provides instructions to a processor for execution. A machine-readable medium can take on many forms including, for example, non-volatile media, volatile media, and transmission media. Non-volatile media can include, for example, optical and magnetic disks. Volatile media can include, for example, dynamic memory. Transmission media can include, for example, coaxial cables, wire, fiber optics, and wires that form a bus. Common forms of machine-readable media can include, for example, floppy disks, flexible disks, hard disks, magnetic tapes, other like magnetic media, CD-ROMs, DVDs, other like optical media, punch cards, paper tapes and like physical media with patterned holes, RAM, ROM, PROM, EPROM and flash EPROM.

In some embodiments, the data and information can be transmitted or otherwise communicated (wired or wirelessly) to a remote location by a communication system (e.g., satellite communication or wide area network communication) for further analysis. The communication system can also allow for monitoring and/or performing of the methods described herein (or portions thereof).

Embodiments disclosed herein include:

A. a method that includes drilling a wellbore penetrating a subterranean formation with a drilling fluid as part of a drilling operation; circulating or otherwise containing the drilling fluid in a flow path that comprises the wellbore; measuring at least one physical property of the drilling fluid at a first location and a second location along the flow path; deriving a compositional property of the drilling fluid at the first location and the second location based on the at least one physical property that was measured; comparing the compositional property of the drilling fluid at the first location and the second location; and changing an operational parameter of the drilling operation based on the comparison;

B. a method that includes drilling a wellbore penetrating a subterranean formation with a drilling fluid as part of a drilling operation; circulating or otherwise containing the drilling fluid in a flow path that comprises the wellbore; measuring at least one physical property of the drilling fluid at a location along the flow path over a period of time; deriving a compositional property of the drilling fluid at the location based on the at least one physical property measured thereat; comparing the compositional property of the drilling fluid at the location over the period of time; and changing an operational parameter of the drilling operation based on the comparison; and C. a method that includes drilling a wellbore penetrating a subterranean formation with a drilling fluid as part of a drilling operation; circulating or otherwise containing the drilling fluid in a flow path that comprises the wellbore; measuring at least one physical property of the drilling fluid at a location along the flow path; deriving a compositional property of the drilling fluid at the location based on the at least one physical property measured thereat; calculating a predicted compositional property at the location based on a plurality of operational parameters of the drilling operation; comparing the compositional property to the predicted compositional property; and changing at least one of the operational parameters of the drilling operation based on the comparison.

Each of embodiments A, B, and C may have one or more of the following additional elements in any combination: Element 1: wherein the at least one physical property is at least one selected from the group consisting of viscosity, density, thermal conductivity, dielectric constant, resistivity, electrical stability, emulsion stability, heat capacity, electrical impedance, permittivity, refractive index, absorptivity, and any combination thereof; Element 2: wherein the compositional property is at least one selected from the group consisting of a presence or absence of a contaminant, a concentration of a component of the drilling fluid, a concentration of cuttings, a concentration of low gravity solids, and any combination thereof; Element 3: wherein the operational parameter is at least one selected from the group consisting of a flow rate of the drilling fluid, a revolutions per minute of a drill bit, a rate of penetration of a drill bit into the subterranean formation, a torque applied to a drill string, a trajectory of a drill bit, a weight on a drill bit, a wellbore pressure, an equivalent circulating density, a concentration of a component of the drilling fluid, a weight of the drilling fluid, a viscosity of the drilling fluid, and any combination thereof; Element 4: wherein the flow path further comprises a tubular extending from outside the wellbore to inside the wellbore, and wherein the first location is along the tubular outside the wellbore and the second location is along the tubular inside the wellbore; Element 5: wherein the flow path further comprises a shaker, and wherein the first location is before the shaker and the second location is after the shaker; Element 6: wherein the flow path further comprises a centrifuge, and wherein the first location is before the centrifuge and the second location is after the centrifuge; Element 7: wherein the flow path further comprises a retention pit, and wherein the first location is before the retention pit and the second location is after the retention pit; Element 8: wherein the flow path further comprises a mixer, and wherein the first location is before the mixer and the second location is after the mixer; Element 9: wherein the steps of measuring, deriving, and comparing are performed over a period of time; Element 10: wherein the step of deriving the composition property uses Formulas I and II; Element 11: wherein the step of deriving the composition property uses Formula III; and Element 12: wherein the step of deriving the composition property uses Formulas IV and V.

By way of non-limiting example, exemplary combinations applicable to A, B, C include: at least two of Elements 1-3 in combination; at least two of Elements 4-8 in combination; at least two of Elements 10-11 in combination; at least one of Elements 1-3 in combination with at least one of Elements 4-8 and optionally at least one of Elements 10-11; at least one of Elements 1-3 in combination with at least one of Elements 10-11; at least one of Elements 4-8 in combination with at least one of Elements 10-11; Element 9 in combination with any of the foregoing; Element 9 in combination with at least one of Element 1-8; and Element 9 in combination with at least one of Elements 10-12.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the embodiments of the present invention. At the very least, and not as an attempt to limit the application of the doctrine of equivalents to the scope of the claim, each numerical parameter should at least be construed in light of the number of reported significant digits and by applying ordinary rounding techniques.

One or more illustrative embodiments incorporating the invention embodiments disclosed herein are presented herein. Not all features of a physical implementation are described or shown in this application for the sake of clarity. It is understood that in the development of a physical embodiment incorporating the embodiments of the present invention, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for those of ordinary skill the art and having benefit of this disclosure.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A method comprising:

drilling a wellbore penetrating a subterranean formation with a drilling fluid as part of a drilling operation, the drilling fluid comprising at least two components;

circulating or otherwise containing the drilling fluid in a flow path that comprises the wellbore;

measuring the thermal conductivity of the drilling fluid at a first location and a second location along the flow path, wherein the flow path further comprises a centrifuge, and wherein the first location is immediately before the centrifuge and the second location is immediately after the centrifuge;

deriving a volume fraction for each of the at least two components of the drilling fluid at the first location and the second location based on the thermal conductivity measured at leach location;

comparing the volume fraction of each of the at least two components of the drilling fluid at the first location and the second location; and changing an operational parameter of the drilling operation based on the comparison.

2. The method of claim 1, wherein the operational parameter is at least one selected from the group consisting of a flow rate of the drilling fluid, a revolutions per minute of a drill bit, a rate of penetration of a drill bit into the subterranean formation, a torque applied to a drill string, a trajectory of a drill bit, a weight on a drill bit, a wellbore pressure, an equivalent circulating density, a concentration of a component of the drilling fluid, a weight of the drilling fluid, a viscosity of the drilling fluid, and any combination thereof.

3. The method of claim 1, wherein the flow path further comprises a tubular extending from outside the wellbore to inside the wellbore, and wherein the thermal conductivity of the drilling fluid is further measured at an entrance to the tubular outside the wellbore and an exit from the tubular inside the wellbore.

4. The method of claim 1, wherein the flow path further comprises a shaker, and wherein the thermal conductivity of the drilling fluid is further measured immediately before the shaker and is immediately after the shaker.

5. The method of claim 1, wherein the flow path further comprises a retention pit, and wherein the thermal conductivity of the drilling fluid is further measured immediately before the retention pit and immediately after the retention pit.

6. The method of claim 1, wherein the flow path further comprises a mixer, and wherein the first location is before the mixer and the second location is after the mixer.

7. The method of claim 1, wherein the steps of measuring, deriving, and comparing are performed over a period of time.

8. The method of claim 1, wherein the at least two components are selected from the group consisting of a continuous phase of the drilling fluid, a discontinuous phase of the drilling fluid, cuttings, gas, low gravity solids, high gravity solids, contaminants, and lost circulation materials.

9. The method of claim 8, wherein at least one of the at least two components are the low gravity solids, and wherein the low gravity solids are one or more solids selected from the group consisting of calcium carbonate, marble, polyethylene, polypropylene, graphitic materials, silica, limestone, dolomite, salt crystals, shale, bentonite, kaolinite, sepiolite, illite, hectorite, insoluble polymeric materials, and organoclays.

10. The method of claim 8, wherein at least one of the at least two components are the high gravity solids, and wherein the high gravity solids are one or more solids selected from the group consisting of barite, hematite, ilmenite, galena, manganese oxide, iron oxide, magnesium tetroxide, magnetite, siderite, celestite, dolomite, manganese carbonate, and insoluble polymeric materials.

11. The method of claim 8, wherein at least one of the at least two components are the lost circulation materials, and wherein the lost circulation materials are one or more materials selected from the group consisting of sand, shale, ground marble, bauxite, ceramic materials, glass materials, metal pellets, silica, alumina, fumed carbon, carbon black, graphite, mica, titanium dioxide, meta-silicate, calcium silicate, kaolin, talc, zirconia, boron, fly ash, hollow glass microspheres, solid glass, synthetic fibers, resilient graphitic carbon, cellulose flakes, wood, resins, uncrosslinked polymer materials, crosslinked polymer materials, polytetrafluoroethylene materials, nut shell pieces, cured resinous particulates comprising nut shell pieces and seed shell pieces, cured resinous particulates comprising seed shell pieces and fruit pit pieces, cured resinous particulates comprising fruit pit pieces, composite materials, basalt fibers, woolastonite fibers, non-amorphous metallic fibers, metal oxide fibers, mixed metal oxide fibers, ceramic fibers, glass fibers, polymeric fibers, and cellulosic fibers.

12. The method of claim 1, wherein the drilling fluid comprises a base fluid and m components, and the volume fraction of each component is determined using Formula I and Formula II:

$$\beta_i = k_i / k_0 \qquad \text{Formula I}$$

$$\frac{k_m}{k_0} = \left[1 + \sum_{i=1}^{m} \left(\beta_i^{\frac{1}{3}} - 1\right)\varphi_i\right]^3 \qquad \text{Formula II}$$

wherein, ki is the thermal conductivity of an ith component;

$k_0$ is the thermal conductivity of the base fluid;

$\varphi_i$ is the volume fraction of the ith component;

km is the thermal conductivity of the drilling fluid; and m is greater than or equal to 2.

* * * * *